US008362382B2

(12) United States Patent
Koizumi et al.

(10) Patent No.: US 8,362,382 B2
(45) Date of Patent: Jan. 29, 2013

(54) PUSH-BUTTON SWITCH

(75) Inventors: Hirofumi Koizumi, Osaka (JP); Satoshi Yamanaka, Osaka (JP)

(73) Assignee: Hosiden Corporation, Yao-shi, Osaka (JP)

( * ) Notice: Subject to any disclaimer, the term of this patent is extended or adjusted under 35 U.S.C. 154(b) by 575 days.

(21) Appl. No.: 12/382,150

(22) Filed: Mar. 10, 2009

(65) Prior Publication Data

US 2009/0229958 A1 Sep. 17, 2009

(30) Foreign Application Priority Data

Mar. 11, 2008 (JP) ..... 2008-061072

(51) Int. Cl.
*H01H 1/12* (2006.01)

(52) U.S. Cl. ..... 200/527; 200/11 TW

(58) Field of Classification Search ..... 200/527, 200/11 TW, 552, 529, 536, 544, 521, 565
See application file for complete search history.

(56) References Cited

U.S. PATENT DOCUMENTS

| | | | | |
|---|---|---|---|---|
| 1,238,283 A | | 8/1917 | Biddle | |
| 1,238,382 A | * | 8/1917 | Biddle | 200/527 |
| 2,007,082 A | * | 7/1935 | Griffith | 362/112 |
| 3,440,380 A | * | 4/1969 | Harasymiak | 200/529 |
| 3,626,452 A | * | 12/1971 | Winter et al. | 74/143 |
| 3,749,871 A | * | 7/1973 | Stoll et al. | 200/527 |
| 3,955,058 A | * | 5/1976 | Alfrey | 200/527 |

FOREIGN PATENT DOCUMENTS

| | | |
|---|---|---|
| JP | 54-72480 | 6/1979 |
| JP | 60-15722 | 2/1985 |
| JP | 60-15723 | 2/1985 |
| JP | 5-97-028 | 12/1993 |
| JP | 5-97028 | 12/1993 |

OTHER PUBLICATIONS

2nd Japanese Office Action for corresponding Japanese Application 2008-061072 (which is JP 4613217).

* cited by examiner

*Primary Examiner* — Elvin G Enad
*Assistant Examiner* — Lisa Homza
(74) *Attorney, Agent, or Firm* — Bacon & Thomas, PLLC

(57) ABSTRACT

A push-button switch having a case which defines a space within which a star wheel is mounted and an indenter which is pressed against an outer periphery of the star wheel. The star wheel has ridge portions. A push button is provided which is mounted on the case for effecting rotation of the star wheel. A contact is also provided which engages the star wheel for corotation and which serves as a movable contact. Also provided are terminals which serve as stationary contacts. The star wheel includes a small projection having a rounded tip end disposed in each ridge portion of the star wheel.

5 Claims, 11 Drawing Sheets

PUSH-BUTTON SWITCH

BACKGROUND OF THE INVENTION

1. Field of the Invention

The present invention relates to a push-button switch in which a movable contact is rotated by a constant angular step in one direction by a depression of a push button, and contacted with stationary contacts in accordance with the rotation angle of the movable contact, thereby performing contact switching.

2. Description of the Prior Art

A positioning mechanism is incorporated into a push-button switch of this type. The positioning mechanism includes: a star wheel which is rotated by a constant angular step in one direction through a ratchet mechanism or the like which is operated by a depression of a push button that automatically returns; and an indenter which is configured by a metal ball or the like, and which is pressed against the outer periphery of the star wheel by a spring. A movable contact is attached so as to corotate with the star wheel (see Patent Reference 1).

The star wheel is hardly stopped at a position where a ridge portion is opposed to the indenter, and rotated to a position where a valley portion is opposed to the indenter to cause the indenter to fit in the valley portion, whereby the star wheel is stopped to hold the position of the movable contact in a return state of the push button (see Patent Reference 1).

In a push-button switch of this type, the indenter is caused to be contacted with the outer periphery of the star wheel which has alternately ridge and valley portions, thereby producing a sense of operation. In this case, it is important to prevent a switch operating force required for pushing the push button, from being increased.

Therefore, a star wheel in which ridge and valley portions having a relatively small inclination angle are alternately formed on the outer periphery is used (see Patent Reference 1).

In such a star wheel, however, slopes of the ridge portions have a small inclination angle. When a load of the indenter is applied to the apex of one of the ridge portions, therefore, a balance is easily established, thereby producing a problem in that the star wheel is easily stopped at a position where the ridge portion is opposed to the indenter.

As a conventional technique for solving the problem, a configuration has been proposed where an inflection point is disposed in a middle of a slope of a ridge portion, and the inclination angle of a slope portion extending from the inflection point to the apex of the ridge portion is set so as to be larger than that of another slope portion extending from the inflection point to the valley portion, whereby the indenter is prevented from being stopped at the ridge portion (see Patent Reference 2).

[Patent Reference 1] Japanese Utility Model Application Laying-Open No. 60-15722

[Patent Reference 2] Japanese Utility Model Application Laying-Open No. 5-97028

SUMMARY OF THE INVENTION

In the conventional technique, the slope in the vicinity of the apex of the ridge portion has the large inclination angle, and abrasion easily occurs in the apex of the ridge portion. Therefore, there is a problem in that, as the number of operations of pressing the push button is more increased, the effect is further lessened, and finally disappears.

In order to solve the above-discussed problems, the invention is configured so that a push-button switch includes: a star wheel which is rotated by a constant angular step in one direction by a depression of a push button that automatically returns; an indenter which is pressed against the outer periphery of the star wheel by a spring; a contact which is attached so as to corotate with the star wheel, and which serves as a movable contact; and terminals with which the contact is contacted in accordance with a rotation angle, and which serve as stationary contacts, and a small projection having a rounded tip end is disposed in each of ridge portions of the star wheel.

According to the invention which has the above-described configuration, when a load of the indenter is applied to the apex of one of the ridge portions, the small projection causes a balance to be hardly established. Even when the slope of each ridge portion does not have a large inclination angle, therefore, the star wheel can be prevented from being stopped at a position where the ridge portion is opposed to the indenter. The effect is exerted while, as the number of operations of pressing the push button is more increased, the effect is not further lessened to finally disappear.

Furthermore, the tip end of the small projection is rounded, and hence the small projection shows excellent abrasion resistance, so that it is possible to surely prevent the phenomenon that, as the number of operations of pressing the push button is more increased, the above-discussed effect is further lessened, and finally disappears, from occurring.

The above effects can be achieved by the small projection which is very smaller than the ridge and valley portions and indenter of the star wheel. Therefore, a force required for the small projection to override the indenter is negligibly small as compared to that required for the ridge portion to override the indenter. The contact switching can be performed by a switch operating force which is equivalent to that in the prior art, and the small projection does not affect the operational sense, so that an operational sense which is equivalent to that in the prior art is obtained.

DESCRIPTION OF REFERENCE NUMERALS

4 push button
7 indenter
8 indenter spring
9*h* movable contact
10*a* common contact (stationary contact)
11*a*, 11*b* first selection contact (stationary contact)
12*a*, 12*b* second selection contact (stationary contact)
15 positioning star wheel
15*a* ridge portion
16 small projection

DETAILED DESCRIPTION OF THE PREFERRED EMBODIMENT

Hereinafter, an embodiment of the invention will be described with reference to the accompanying drawings.

In the embodiment, a push-button switch in which two kinds of switch circuits are opened/closed by a depression of a push button is shown. For example, the push-button switch is used in an application where the turn on/off of a vehicle interior lamp is switched. When the push button is depressed in the state where the lamp is turned off, a turn-off circuit is opened, and a turn-on circuit is closed. When the push button is depressed in the state where the lamp is turned on, the turn-on circuit is opened, and the turn-off circuit is closed.

Figure 3:
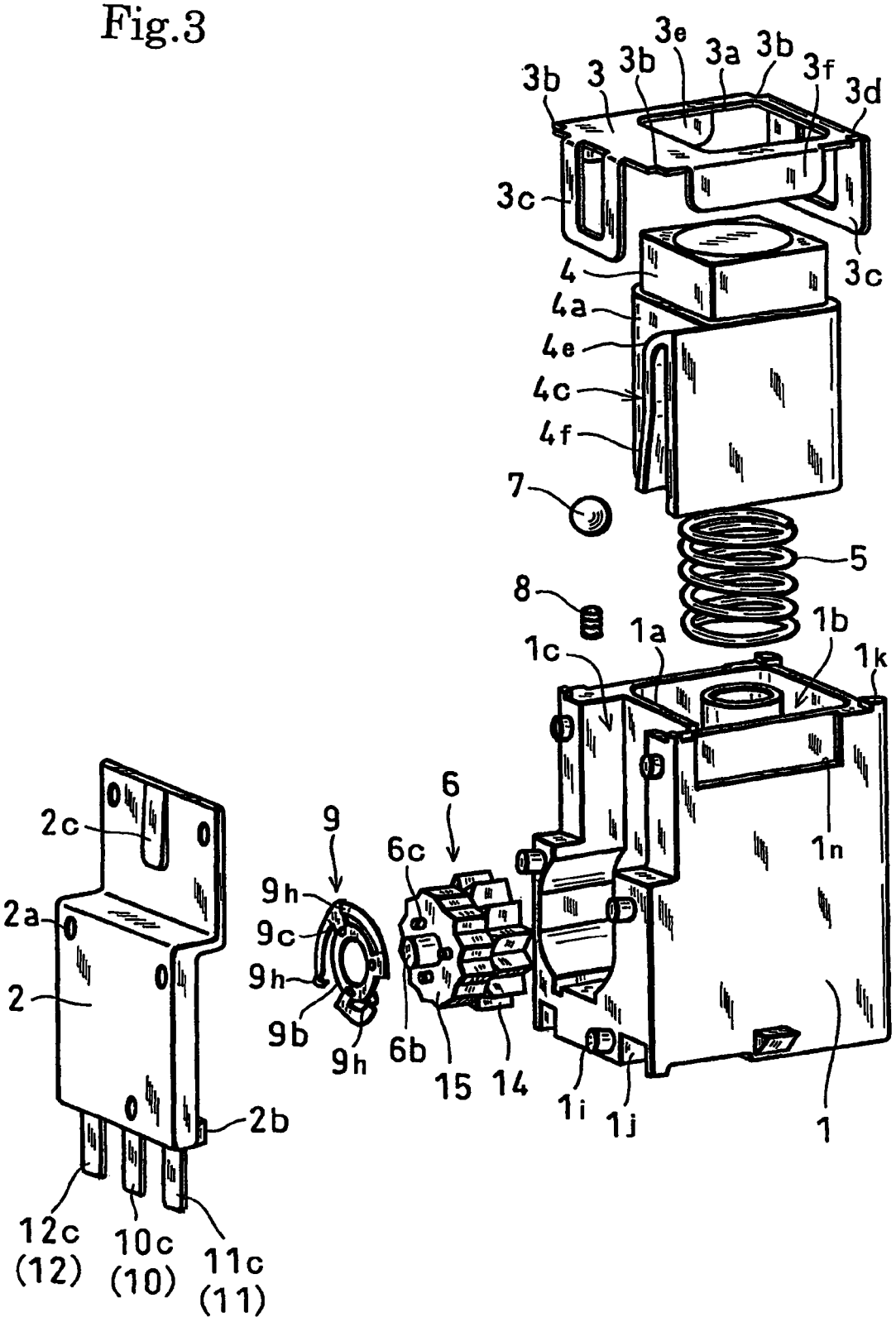
FIG. 3 is an exploded view of the push-button switch of the embodiment of the invention.

As shown in FIG. 3, the push-button switch is configured by: a case 1 which is made of a synthetic resin, and which is insulative; a terminal base 2 which is made of a synthetic resin, and which is insulative; a cover 3 which is formed by stamping and bending a metal plate; the push button 4 which is made of a synthetic resin, and which is insulative; a push-button return spring 5 which is configured by a metal coil spring; a rotor 6 which is made of a synthetic resin, and which is insulative; an indenter 7 which is configured by a metal ball (or a roller); an indenter spring 8 which is configured by a metal coil spring; and a contact 9 which is formed by stamping and bending a highly conductive thin metal plate.

As shown in FIGS. 2 to 5, 6A, and 6B, the case 1 is formed into a box-like shape in which one side face and the upper face are opened. Hereafter, the description will be made while assuming that the opened one side face of the case 1 is the front side face of the push-button switch.

Inside the case 1, a partition wall 1*a* which is protruded in parallel to the rear side wall from a front portion of the inner face of the left side wall, and which does not reach a front portion of the inner face of the right side wall is disposed. The interior space of the case 1 is partitioned by the partition wall 1*a* into a push-button housing space 1*b* in which the upper face is opened, and a rotor housing space 1*c* in which the upper face and the front side face are opened. The two spaces 1*b*, 1*c* communicate with each other through a gap 1*d* between a right end portion of the partition wall 1*a* and a front portion of the inner face of the right side wall.

A cylindrical push-button guide 1*e* is vertically raised from the bottom face in a center portion of the push-button housing space 1*b*. A rotor shaft 1*f* having a longitudinal axis is protruded from the partition wall 1*a* in a lower portion of the rotor housing space 1*c*. An intender housing recess 1*g* is disposed in the bottom side of the rotor housing space 1*c*. A pair of right and left intender pressing nails 1*h* are raised from the right and left sides of the recess, respectively. In a center portion of the intender housing recess 1*g*, an indenter spring rod 1*p* is vertically raised from the bottom face. The axes of the intender housing recess 1*g* and the indenter spring rod 1*p* are in a vertical plane including the axis of the rotor shaft 1*f*.

Outside of the case 1, disposed are a plurality of base fixing pins 1*i* which are forward protruded from an opening edge portion of the front side face of the case 1, base fitting recesses 1*j* which are formed in lower right and left corners of the opening edge portion of the front side face of the case 1, cover positioning projections l*k* which are upward protruded from the four corners of an opening edge portion of the upper face of the case 1, a cover engaging hook 1*m* which is rearward protruded from an upper portion of the outer face of the rear side wall of the case 1, and shallow cover fitting recesses 1*n* which are formed in upper portions of the outer faces of the right and left side walls of the case 1.

In the terminal base 2, as shown in FIGS. 2, 3, 7A, and 7B, a plurality of different terminals (in the embodiment, three terminals of three kinds, or a common terminal 10, a first selection terminal 11, and a second selection terminal 12) which are formed by stamping and bending a highly conductive thin metal plate are integrated with one another by insert molding. The terminal base is formed into a lid-like shape which covers the opened front side face of the case 1.

In the terminal base 2, a plurality of pin holes 2*a* which are passed between the inner and outer faces formed on an outer side portions of the terminal base 2, fitting projections 2*b* which are protruded from right and left corners of a lower portion of the inner face of the terminal base 2, and a cover engaging hook 2*c* which is protruded from an upper portion of the outer face of the terminal base 2.

A circular contact housing recess 2*d* which, when the terminal base 2 is attached to the opened front side face of the case 1, is concentric with the rotor shaft 1*f* is disposed in the inner face of the terminal base 2. A bearing recess 2*e* is disposed in a center portion of the contact housing recess.

A common contact 10*a*, two first selection contacts 11*a*, 11*b*, and two second selection contacts 12*a*, 12*b* which serve as stationary contacts are disposed at intervals in plural places on the same circumference in an outer peripheral portion of the bottom face of the contact housing recess 2*d*, respectively.

The common contact 10*a* is formed by, in a substantially flush manner, exposing one end portion of the common terminal 10 among the terminals embedded in the terminal base 2 in one place which is in an outer peripheral portion of the bottom face of the contact housing recess 2*d*, and which is different from the places of the other stationary contacts, and therefore is a stationary contact which is conductive with the common terminal 10.

The two first selection contacts 11*a*, 11*b* are formed by splitting one end portion of the first selection terminal 11 among the terminals embedded in the terminal base 2 into two pieces, and, in a substantially flush manner, exposing the two pieces in two places which are in the outer peripheral portion of the bottom face of the contact housing recess 2*d*, and which are different from the places of the other stationary contacts, and therefore are stationary contacts which are conductive with the first selection terminal 11.

The two second selection contacts 12*a*, 12*b* are formed by splitting one end portion of the second selection terminal 12 among the terminals embedded in the terminal base 2 into two pieces, and, in a substantially flush manner, exposing the two pieces in two places which are in the outer peripheral portion of the bottom face of the contact housing recess 2*d*, and which are different from the places of the other stationary contacts, and therefore are stationary contacts which are conductive with the second selection terminal 12.

Figure 7A:
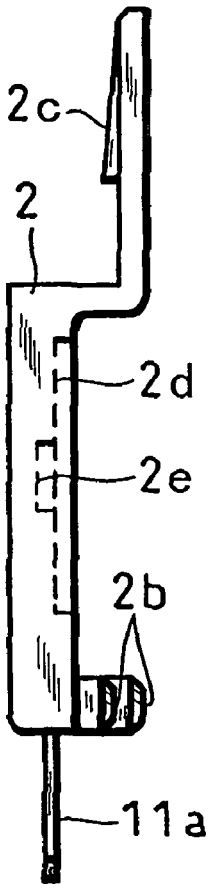
FIG. 7A is a side view of a terminal base of the push-button switch of the embodiment of the invention.
Figure 7B:
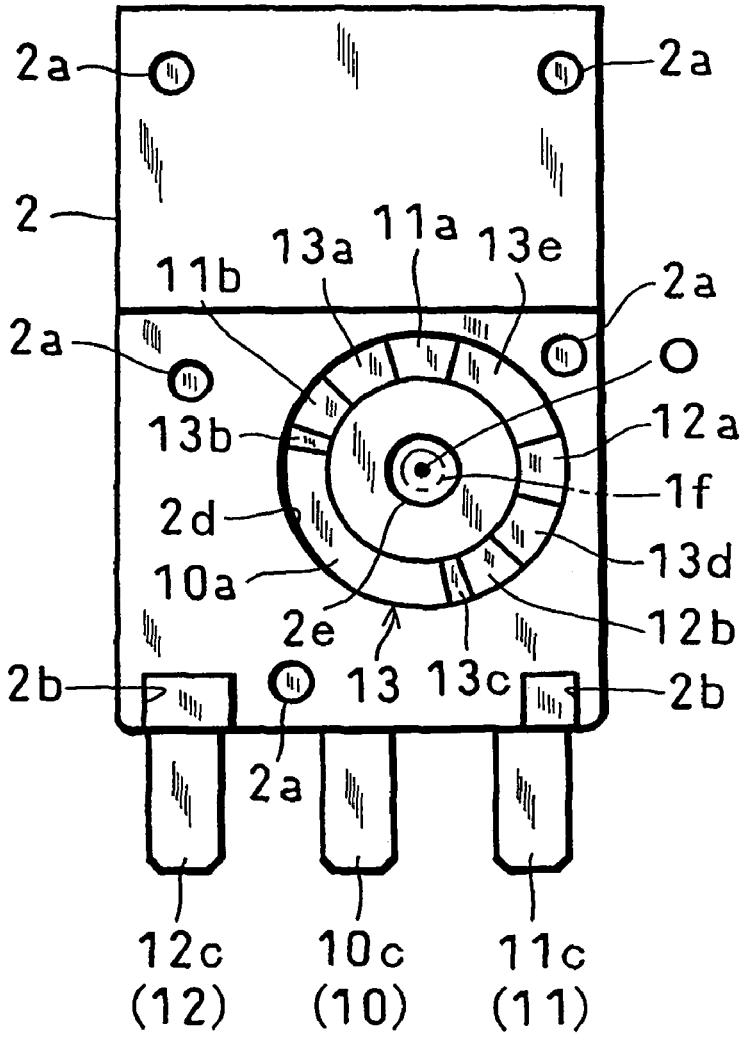
FIG. 7B is a rear (inner face) view of the terminal base.
Figure 8A:
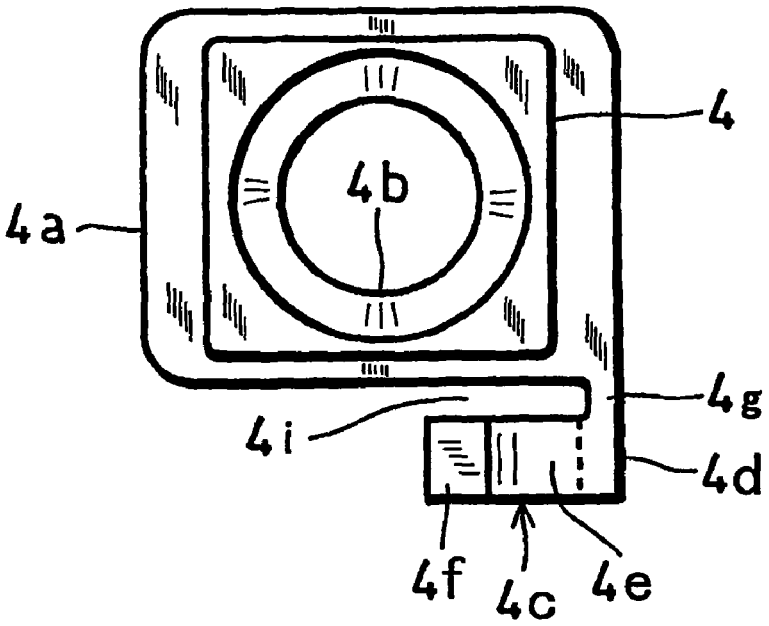
FIG. 8A is a side view of a push button of the push-button switch of the embodiment of the invention.
Figure 8B:
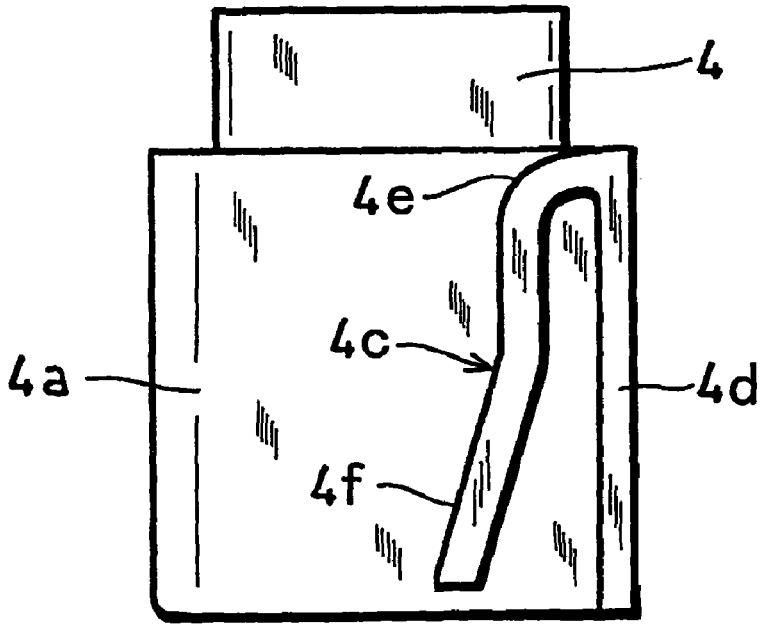
FIG. 8B is a side view of the push button.

Referring to FIG. 7B (FIGS. 10A and 10B), in a counter-clockwise direction (clockwise direction) with starting from a stationary contact disposed in one place of the outer peripheral portion of the bottom face of the contact housing recess 2*d*, for example, the one first selection contact 11*a* having an arcuate shape of a central angle of 30 deg., a first insulation contact 13*a* which is formed by an arcuate resin surface of a central angle of 30 deg., the other first selection contact 11*a* having an arcuate shape of a central angle of 25 deg., a second insulation contact 13*b* which is formed by an arcuate resin surface of a central angle of 7.5 deg., the arcuate common contact 10*a* of a central angle of 115 deg., a third insulation contact 13*c* which is formed by an arcuate resin surface of a central angle of 7.5 deg., the arcuate other second selection contact 12*b* of a central angle of 25 deg., a fourth insulation contact 13*d* which is formed by an arcuate resin surface of a central angle of 30 deg., the arcuate one second selection contact 12*a* of a central angle of 30 deg., and a fifth insulation contact 13*e* which is formed by an arcuate resin surface of a central angle of 60 deg. are disposed in this sequence, so that an annular movable-contact sliding face 13 is formed concentrically with the rotor shaft 1*f*.

The other end sides of the common terminal 10, the first selection terminal 11, and the second selection terminal 12 which are embedded in the terminal base 2 in an insulated state are protruded in one lateral row at intervals from the lower end face of the terminal base 2, and formed as external connecting terminal portions 10*c*, 11*c*, 12*c* of the push-button switch, respectively.

As shown in FIGS. 2 to 5, the cover 3 is formed into a lid-like shape which covers the opened upper face of the case 1.

In the cover 3, a push button hole 3*a* which is formed at a position of the cover 3 opposed to the push-button housing space 1*b*, which is slightly smaller than the upper face opening of the push-button housing space 1*b*, through which the push button 4 can be passed, and which is passed between the inner and outer faces, cutaway portions 3*b* which are formed in four corner portions of the cover 3, a pair of front and rear U-like leg portions 3*c*, 3*d* which are bent and downward elongated from the front and rear edges of the cover 3, respectively, and a pair of left and right leg portions 3*e*, 3*f* which are bent and downward elongated from the left and right edges of the cover 3, respectively are disposed.

In the push button 4, as shown in FIGS. 3 to 5, 8A, and 8B, a sliding portion 4*a* which is formed under the push button 4, which is slightly larger than the push button 4, and which can be vertically slidably fitted into the push-button housing space 1*b* of the case 1, a center hole 4*b* which is passed between the upper face of the push button 4 and the lower face of the sliding portion 4*a*, and a feed lever 4*c* which is formed in the front side of the sliding portion 4*a* and shifted toward the right side, and which has a substantially inverted U-like shape as seen from the front side are integrally disposed.

In the feed lever 4*c*, a linear fixing piece portion 4*d* which is vertically elongated, a folded back portion 4*e* which is formed in an upper end portion of the fixing piece portion 4*d*, and which is substantially quarter arcuate, a pressing piece portion 4*f* which is downward elongated from the folded back portion 4*e*, and which is bent into an L-like shape so that the gap between the portion and the fixing piece portion 4*d* is gradually expanded in the range from the middle to the lower end, and a connecting portion 4*g* which extends from one side end face of the fixing piece portion 4*d* toward the sliding portion 4*a*, and which causes the fixing piece portion 4*d* to be formed wider than the folded back portion 4*e* and the pressing piece portion 4*f* are integrally disposed.

In the feed lever 4*c*, the fixing piece portion 4*d* is integrally coupled to a right end portion of the front side face of the sliding portion 4*a* via the connecting portion 4*g*, a gap 4*i* is disposed between the front side face of the sliding portion 4*a*, and the folded back portion 4*e* and the pressing piece portion 4*f*, and the pressing piece portion 4*f* can be elastically deformed in the lateral directions along the front side face of the sliding portion 4*a*.

Figure 1:
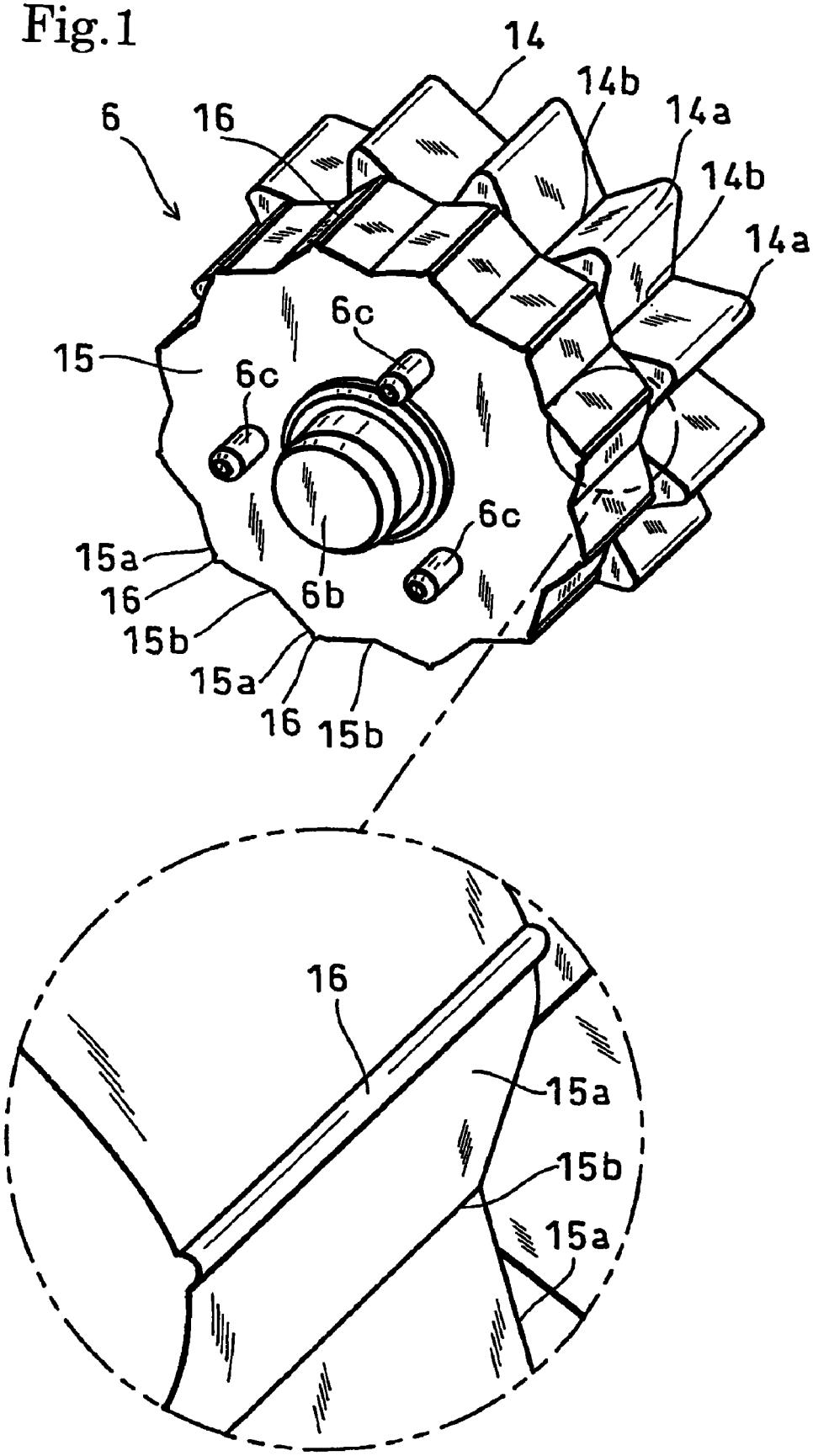
FIG. 1 is a perspective view of a rotor (star wheel) of a push-button switch of an embodiment of the invention.
Figure 5:
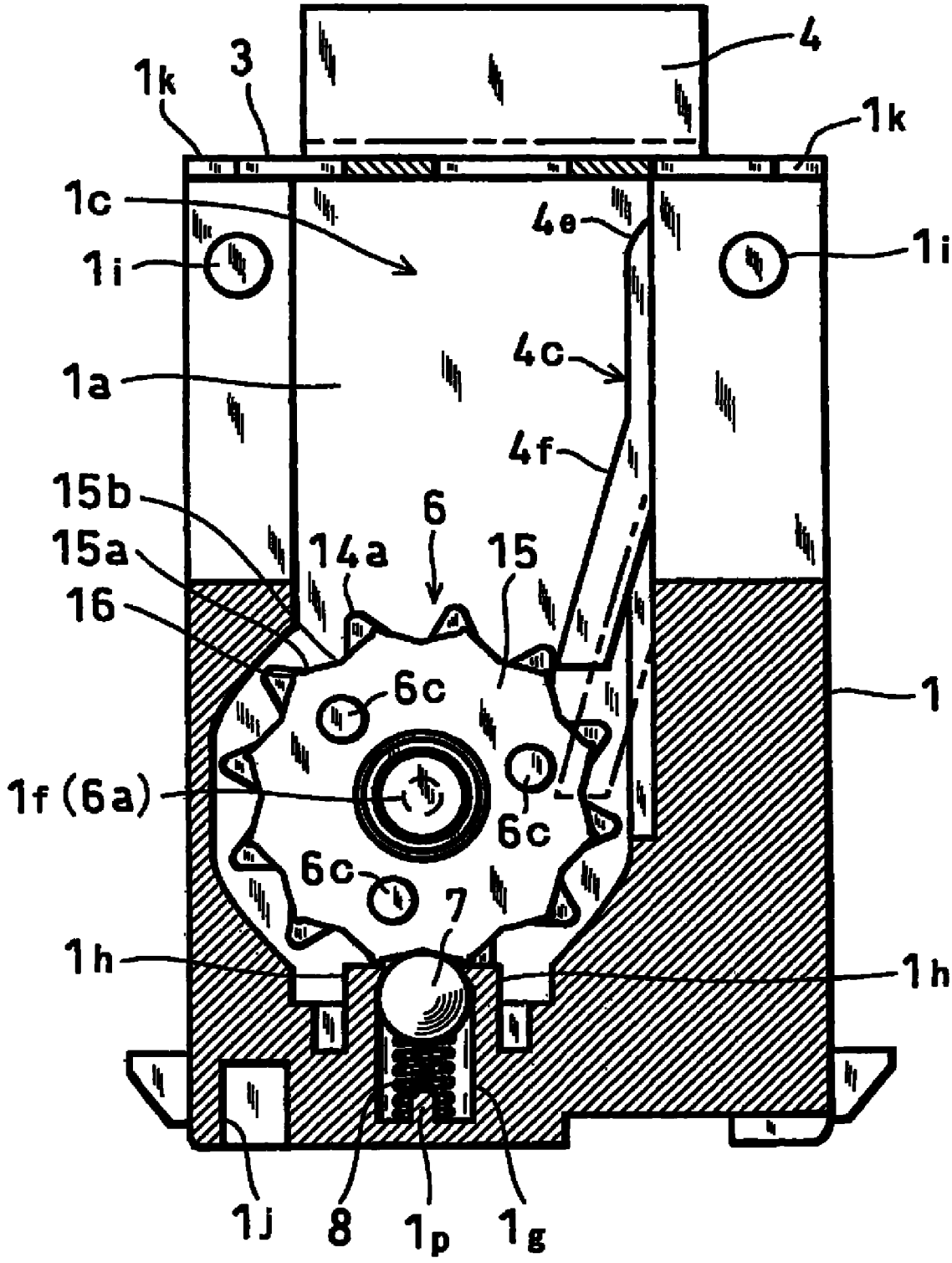
FIG. 5 is a longitudinal section view of a driving mechanism portion and positioning mechanism portion of the push-button switch of the embodiment of the invention.
Figure 6A:
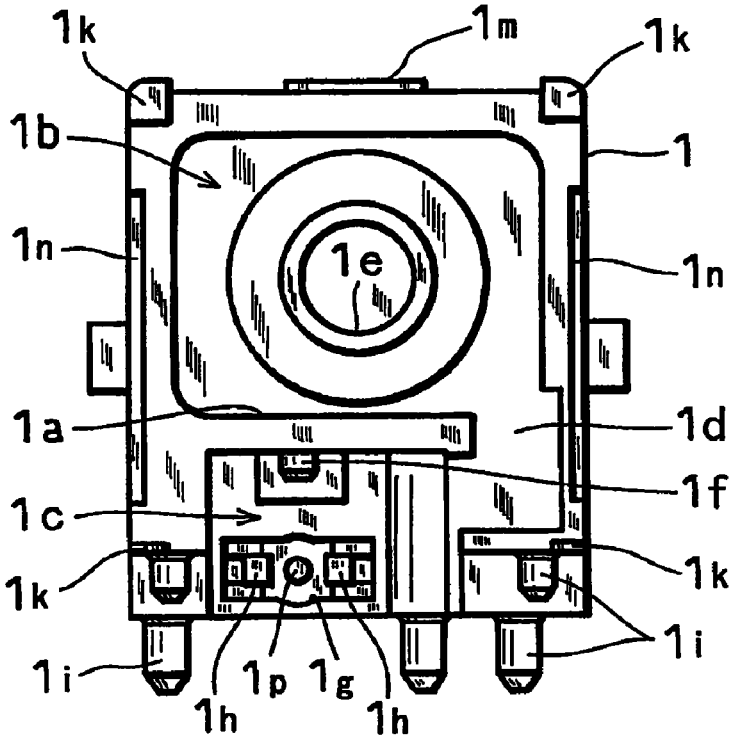
FIG. 6A is a plan view of a case of the push-button switch of the embodiment of the invention.
Figure 6B:
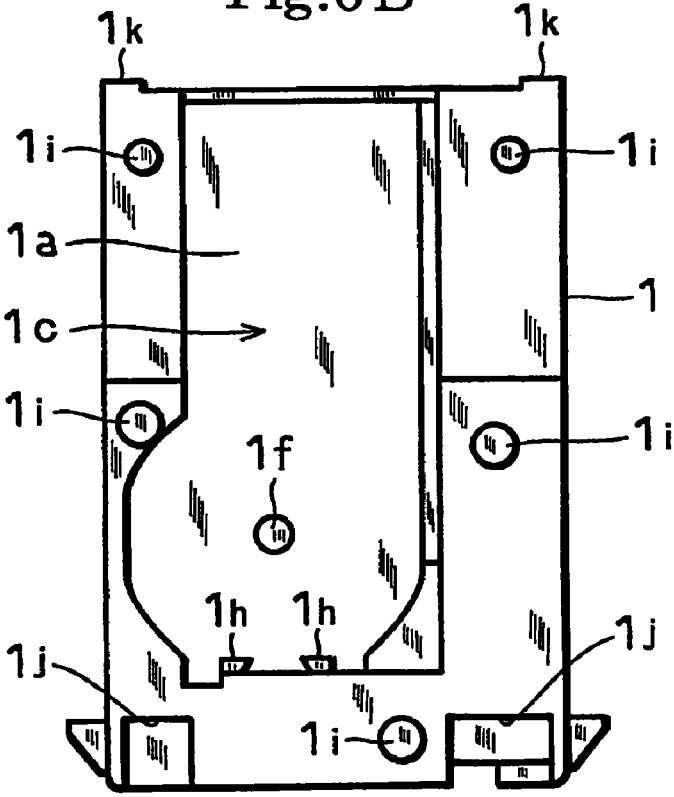
FIG. 6B is a side view of the case.

In the rotor 6, as shown in FIGS. 1, 3, and 5, a rotation star wheel 14 and a positioning star wheel 15 are integrally formed on the same axis.

In the rotor 6, a circular bearing recess 6*a* which is formed in a center portion of the side face on the side of the rotation star wheel 14, a rotor shaft 6*b* which is perpendicularly protruded from a center portion of the side face on the side of the positioning star wheel 15, and contact mounting pins 6*c* which are disposed on the side face on the side of the positioning star wheel 15, and which are perpendicularly protruded from three places that are at regular intervals on the same circumference concentric with the rotor shaft 6*b* are integrally disposed.

The rotation star wheel 14 has alternately ridge portions 14*a* and valley portions 14*b* on the outer periphery. The positioning star wheel 15 has alternately ridge portions 15*a* and valley portions 15*b* which are equal in number (twelve) to those of the rotation star wheel 14, on the outer periphery. In the star wheels 14, 15, the apexes of the ridge portions 14*a*, 15*a* are rounded.

In order to allow the lower end of the pressing piece portion 4*f* of the feed lever 4*c* of the push button 4 to be easily butted against the slopes of the ridge portions 14*a* of the rotation star wheel 14, the inclination angle of each of the slopes is set to an angle which is larger than 45 deg., for example, 60 deg. By contrast, the inclination angle of each of the slopes of the ridge portions 15*a* of the positioning star wheel 15 is set to an angle which is smaller than 45 deg., for example, 30 deg. so that the pressing force (switch operating force) required for depressing the push button 4 is not large, but not so excessively small that the push button 4 is accidentally depressed, and also so that a clear operational sense can be produced.

As shown in FIG. 1, a small projection 16 is disposed in the apex of each of the ridge portions 15*a* of the positioning star wheel 15.

Each small projection 16 has a substantially semicircular section shape. The tip end of the small projection 16 is rounded.

The external shape of the small projection 16 is formed into a streak shape which is parallel to the axis of the positioning star wheel 15. The small projection 16 is disposed on the apex of the corresponding ridge portion 15*a* over the whole width thereof.

As shown in FIGS. 3, 9A, 9B, 10A, and 10B, the contact 9 is formed into a disk-like shape.

Figure 9A:
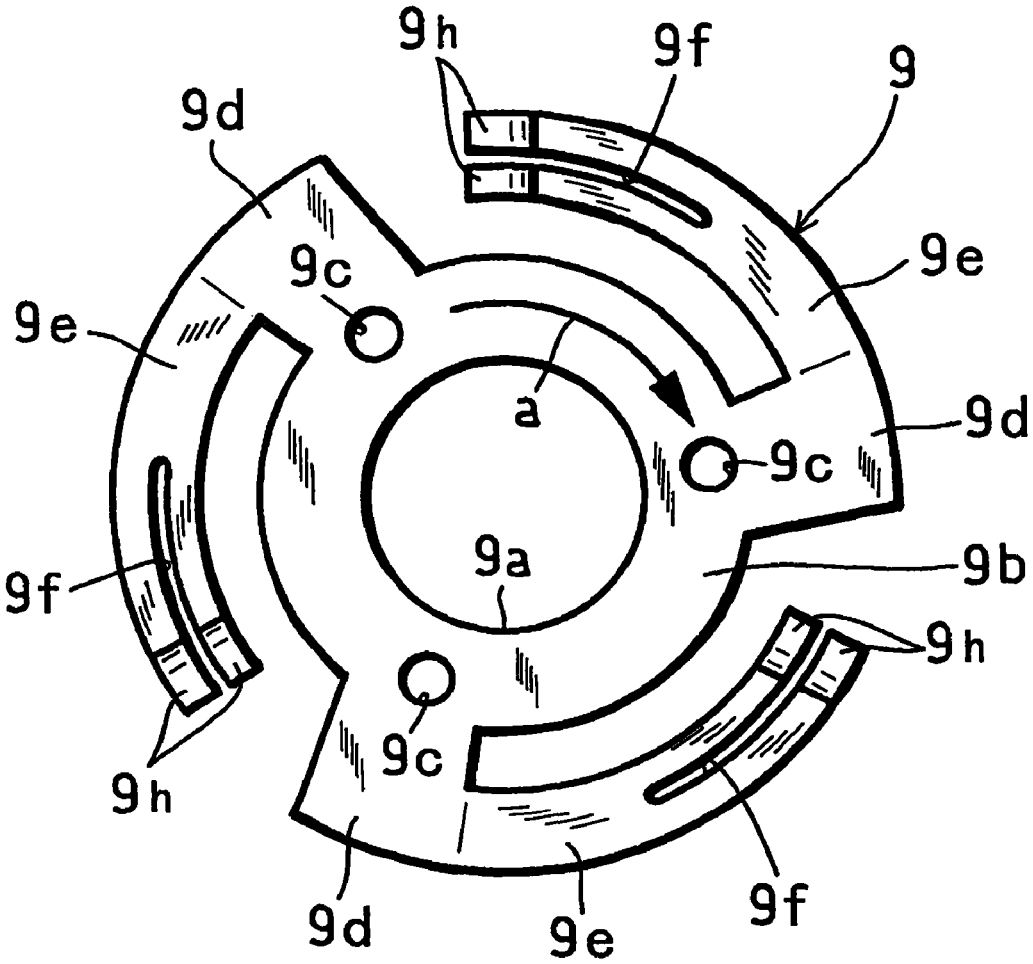
FIG. 9A is a front view of a contact of the push-button switch of the embodiment of the invention.
Figure 9B:
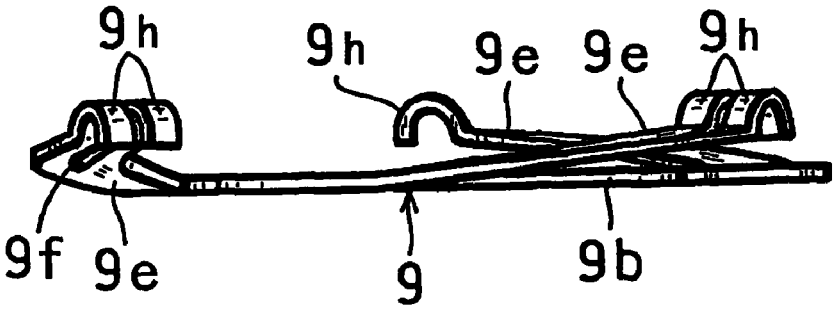
FIG. 9B is a bottom view of the contact.

In the contact 9, a circular center hole 9*a* which is formed at the center of the contact, and which is passed between the inner and outer faces, a concentric annular connecting portion 9*b* which is formed in the periphery of the hole, mounting holes 9*c* which are formed at regular intervals in three places of the connecting portion 9*b*, and which are passed between the inner and outer faces, protruding pieces 9*d* which are radially protruded at regular intervals from three places of the connecting portion 9*b*, cantilever-like movable contact pieces 9*e* which arcuately extend from the protruding pieces 9*d* in regular spaces therebetween and in the peripheries of the connecting portion 9*b* while being separated by a constant gap therefrom, in a direction (counterclockwise direction) of the contact 9 that is opposite to the rotation direction (clockwise direction) indicated by the arrow a in FIG. 9A, slits 9*f* which bifurcate the movable contact pieces 9*e*, respectively, and semicircular movable contacts 9*h* which are formed at the tip ends of the respective movable contact pieces 9*e* so that the surface is convex and the rear face is concave are integrally formed.

In each of the movable contact pieces 9*e*, an inclination angle is formed so that the movable contact piece is gradually raised as advancing from the basal end toward the tip end. The movable contact piece 9*e* is elastically displaceable in the thickness direction of the contact 9.

The movable contact pieces 9*e* are formed into the same shape. The movable contacts 9*h* are disposed in the outer peripheral portion of the contact 9 and in three places that are at regular intervals on the same circumference concentric with the center hole 9*a*.

The outer peripheral edges of the protruding pieces 9*d*, and those of the movable contact pieces 9*e* are on the same circumference concentric with the center hole 9*a*, so that the external shape of the contact 9 is formed into a circular shape which is interrupted by the gaps between the tip ends of the movable contact pieces 9*e* and the protruding pieces 9*d* which are separated from the tip ends in a direction opposite to the rotation direction a of the contact 9.

The push-button switch is assembled in the following manner. The indenter spring 8 is dropped through the gap between the intender pressing nails 1*h* into the intender housing recess 1*g* of the case 1, and located outside the indenter spring rod 1*p* in the intender housing recess 1*g*. Then, the indenter 7 is pressingly installed through the gap between the intender pressing nails 1*h* into the intender housing recessing.

The indenter spring 8 is compressed between the indenter 7 and the bottom face of the intender housing recess 1*g* to always upward urge the indenter 7, and the intender pressing nails 1*h* press the indenter 7 from the upper side, thereby preventing the indenter from jumping out of the intender housing recess 1*g*. A part of the indenter 7 is protruded between the intender pressing nails 1*h* toward the bottom of the rotor housing space 1*c*. The center of the indenter 7 is located in a vertical plane including the axis of the rotor shaft 1*f*.

In a state where the rear face of the contact 9 is opposed to the side face of the rotor 6 on the side of the positioning star wheel 15, while the contact mounting pins 6*c* are fitted into the corresponding contact mounting holes 9*c*, the rotor shaft 6*b* is fitted into the corresponding center hole 9*a*, and the contact 9 is incorporated in a corotatable manner to the side face of the rotor 6 on the side of the positioning star wheel 15.

The rotor 6 to which the contact 9 is incorporated is incorporated to the case 1 to which the indenter spring 8 and the indenter 7 are incorporated. In a state where the opened front side face of the case 1 is opposed to the sidex face of the rotor 6 on the side of the rotation star wheel 14, while the rotor shaft if on the side of the case 1 is fitted into the bearing recess 6*a* on the side of the rotor 6, the rotor 6 to which the contact 9 is incorporated is incorporated to the lower portion of the rotor housing space 1*c* of the case 1.

The terminal base 2 is incorporated to the case 1 where the rotor 6 to which the contact 9 is incorporated is installed. In a state where the opened front side face of the case 1 is opposed to the inner face of the terminal base 2, while the base fixing pins 1*i* are fitted into the corresponding pin holes 2*a*, and the fitting projections 2*b* are fitted into the corresponding fitting recesses 1*j*, the rotor shaft 6*b* on the side of the rotor 6 is fitted into the bearing recess 2*e* on the side of the terminal base 2, and the terminal base 2 is incorporated to the opened front side face of the case 1.

The tip ends of the base fixing pins 1*i* which are protruded from the outer face of the terminal base 2 are fused and collapsed, so that the terminal base can be fixed by the opened front side face of the case 1.

The opened front side face of the case 1 is covered by the terminal base 2, and the opening of the front side face of the rotor housing space 1*c* is closed by the terminal base 2.

The both sides of the rotor 6 are rotatably supported by the coaxial rotor shafts 6*b*, 1*f* on the inner faces of the opposed front and rear sidewalls (the terminal base 2 and the partition wall 1*a*) of the rotor housing space 1*c*, respectively.

The contact 9 is sandwiched between the side face of the rotor 6 on the side of the positioning star wheel 15 and the bottom face of the contact housing recess 2*d*, and the surfaces of the movable contacts 9*h* are pressed against the movable-contact sliding face 13 by the elasticity of the movable contact pieces 9*e*. By the reaction force against the pressing, the contact 9 is rotatably fitted into the contact housing recess 2*d* in a state where the rear faces of the connecting portion 9*b* and the protruding pieces 9*d* are butted against the side face of the rotor 6 on the side of the positioning star wheel 15.

Furthermore, the push-button return spring 5 is incorporated outside the push-button guide 1*e* in the push-button housing space 1*b* of the case 1.

The push button 4 is incorporated to the case 1 to which the terminal base 2 and the push-button return spring 5 are incorporated, in the following manner. While the push-button guide 1*e* is fitted into the center hole 4*b* and the connecting portion 4*g* between the sliding portion 4*a* and the feed lever 4*c* is fitted into the gap 1*d* of the case 1, the sliding portion 4*a* is fitted into the push-button housing space 1*b* of the case 1, and the feed lever 4*c* is fitted into the rotor housing space 1*c* of the case 1, whereby the push button 4 is incorporated with being protruded to the upper side of the push-button housing space 1*b* of the case 1.

Finally, the cover 3 is incorporated to the case 1 to which the push button 4 is incorporated, in the following manner. While an upper portion of the case 1 is fitted into the inside of the front, rear, right, and left leg portions 3*c*, 3*d*, 3*e*, 3*f*, and the push button 4 is fitted into the push button hole 3*a*, the cover positioning projections 1*k* are fitted into the corresponding cutaway portions 3*b* to incorporate the cover 3 to the opened upper face of the case 1.

The cover 3 can be fixed to the opened upper face of the case 1 by fitting the right and left leg portions 3*e*, 3*f* into the corresponding cover fitting recesses In, and fitting the cover engaging hooks 1*m*, 2*c* into the inside of the front and rear leg portions 3*c*, 3*d* to be engaged therewith.

In the case 1, the opened upper face in the periphery of the push button 4 is covered by the cover 3, and the upper face opening of the rotor housing space 1*c* is closed by the cover 3.

The push-button return spring 5 is compressed between a spring seat of the lower face of the sliding portion 4*a* and that of the bottom face of the push-button housing space 1*b*, to always upward urge the push button 4. The push button 4 is protruded to the side of the upper face of the cover 3 through the push button hole 3*a* while the upper end of the sliding portion 4*a* which extends in the lower periphery of the button is pressed by the opening edge portion of the push button hole 3*a* of the cover 3.

In the thus assembled push-button switch, the case 1, the terminal base 2, and the cover 3 constitute a switch outer case in which the push button 4 is protruded from the upper face, the external connecting terminal portions 10*c*, 11*c*, 12*c* are protruded from the bottom side, and the stationary contacts 10*a*, 11*a*, 11*b*, 12*a*, 12*b* are disposed on the side of the inner face to which the movable contacts 9*h* are opposed.

The feed lever 4*c* and the rotation star wheel 14 of the rotor 6 constitute a switch driving mechanism which converts the pressing operation of the push button 4 to a rotary motion, and which applies the rotary motion to the movable contacts 9*h*.

The positioning star wheel 15 of the rotor 6, the indenter 7, and the indenter spring 8 constitute a positioning mechanism which holds the positions of the movable contacts 9*h* in a state where the push button returns.

Figure 2:
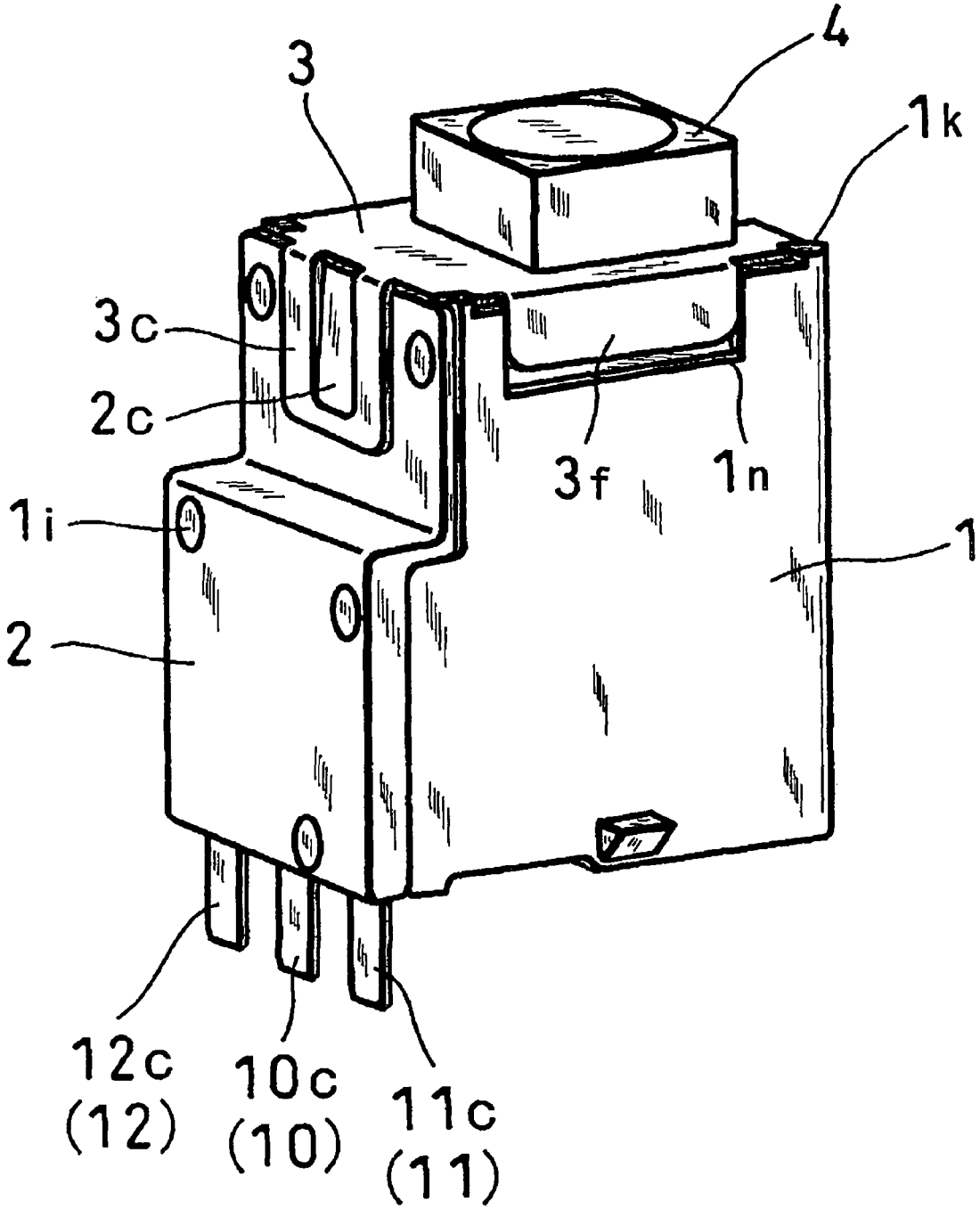
FIG. 2 is a perspective view of the push-button switch of the embodiment of the invention.
Figure 4:
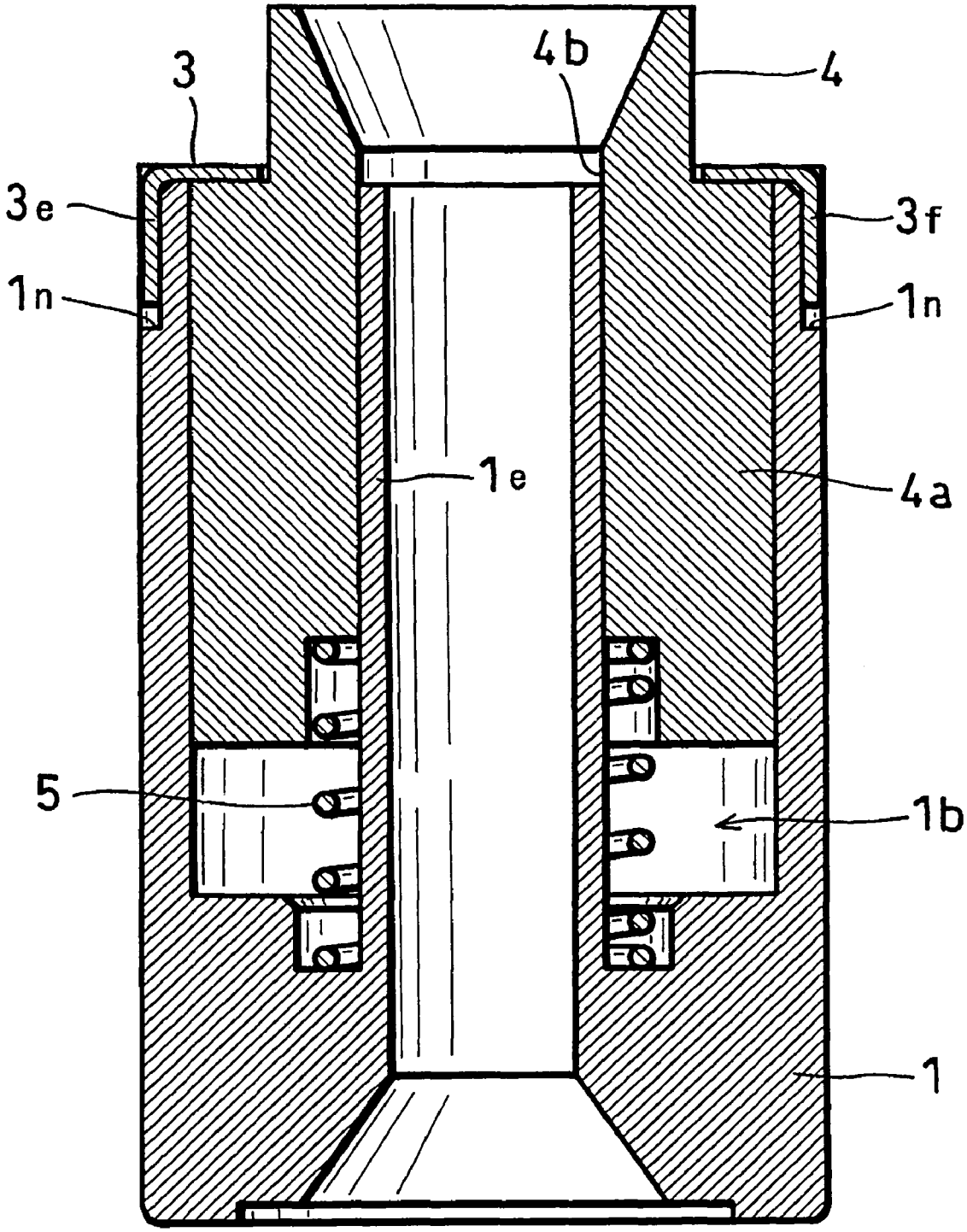
FIG. 4 is a longitudinal section view of a push button portion of the push-button switch of the embodiment of the invention.

Next, the operation of the push-button switch will be described. FIGS. 2, 4, and 5 show the state where the push button returns. In this state, the push button 4 is not depressed, and therefore returns to a free position where the upper end of the sliding portion 4*a* butts against the cover 3, and the lower end of the pressing piece portion 4*f* of the feed lever 4*c* is held at a nonoperating position.

The non-operating position where the lower end of the pressing piece portion 4*f* of the feed lever 4*c* is held in the state where the push button returns is a position where, when the lower end of the pressing piece portion 4*f* is upward moved on a tangent line at a point of a pitch circle of the rotation star wheel 14 where a horizontal line passing the center of the rotation star wheel 14 intersects on the right side of the center, the lower end of the pressing piece portion 4*f* is separated from the rotation star wheel 14 on the side above the horizontal line passing the center.

A part of the indenter 7 which is protruded toward the bottom of the rotor housing space 1*c* is fitted into a certain one of the valley portions 15*b* of the positioning star wheel 15 to restrict free rotation of the rotor 6 and the contact 9, thereby holding the positions of the movable contacts 9*h*.

Figure 10A:
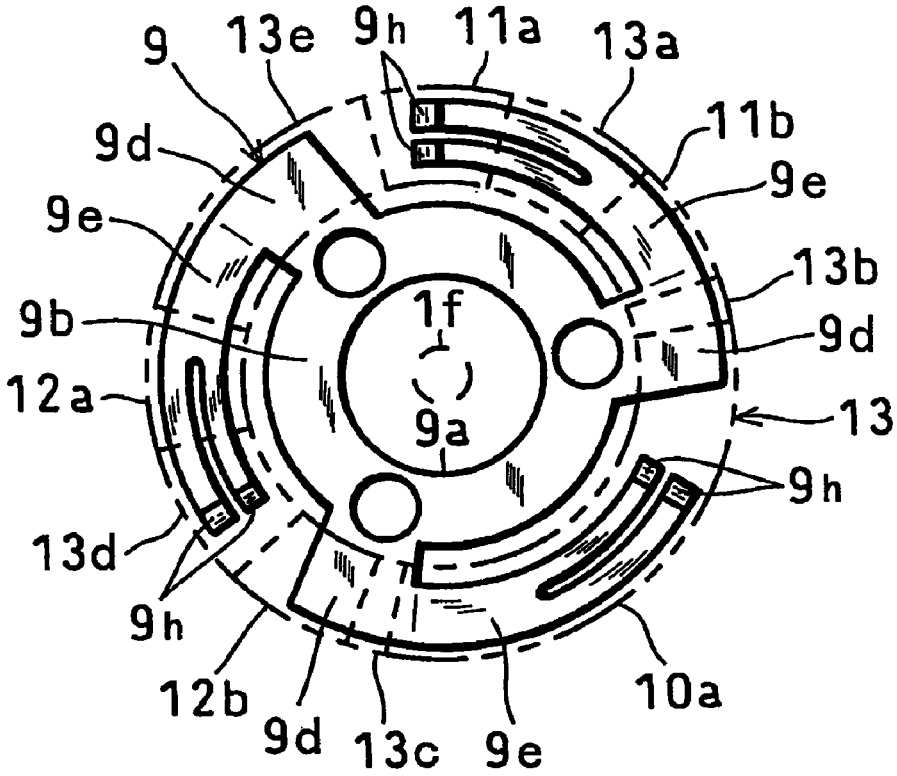
FIG. 10A is a front view of a contact portion of the push-button switch of the embodiment of the invention.

At this time, the state of the contact portion of the push-button switch is as shown in, for example, FIG. 10A. Namely, a certain one of three movable contacts 9*h* is contacted with the common contact 10*a*, another one of the movable contacts 9*h* is contacted with the one first selection contact 11*a*, and the remaining one movable contact 9*h* is contacted with the fourth insulation contact 13*d*. Therefore, the common terminal 10 is conductive with the first selection terminal 11, and the second selection terminal 12 is non-conductive, so that the turn-on circuit of the vehicle interior lamp is opened, and the turn-off circuit is closed.

When the push button 4 in the return state is pushed and depressed, the sliding portion 4*a* and the feed lever 4*c* are downward moved integrally with the push button 4, and the sliding portion 4*a* compresses the push-button return spring 5. The lower end of the pressing piece portion 4*f* of the feed lever 4*c* butts against the slope of a certain one of the ridge portions 14*a* of the rotation star wheel 14, and depresses the ridge portion. Therefore, the rotor 6 and the contact 9 are rotated about the rotor shafts if, 6*b* by a constant angle in the direction a (clockwise direction). In the embodiment, the rotation angle of the rotor 6 and the contact 9 due to the pressing stroke of the push button 4 is 30 deg.

Figure 10B:
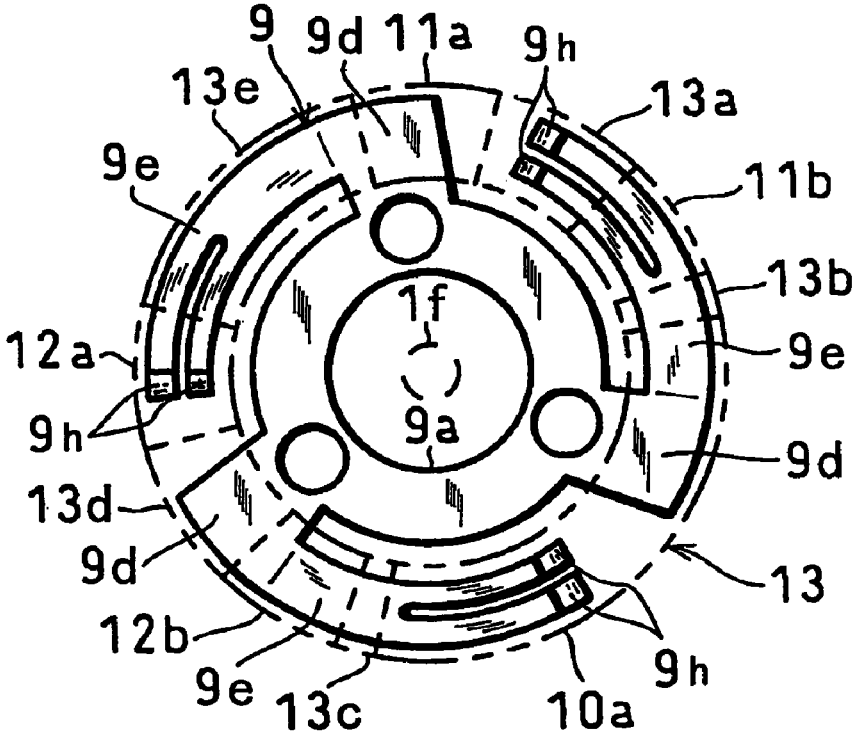
FIG. 10B is a front view of the contact portion after switching.

The three movable contacts 9*h* slide over the movable-contact sliding face 13 while being rotated in conjunction with the rotor 6 and the contact by a rotation angle of 30 deg. about the rotor shafts 1*f*, 6*b* in the direction a (clockwise direction). Among the three movable contacts 9*h*, as shown in FIG. 10B, the certain one movable contact 9*h* which has been contacted with the common contact 10*a* is not caused by the rotation angle to pass over the common contact 10*a*, and hence remains to be contact therewith, the other one movable contact 9*h* which has been contacted with the one first selection contact 11*a* is contacted with the first insulation contact 13*a* which is disposed at the position corresponding to the rotation angle, and the remaining one movable contact 9*h* which has been contacted with the fourth insulation contact 13*d* is contacted with the one second selection contact 12*a* which is disposed at the position corresponding to the rotation angle, thereby switching the contacts. Therefore, the common terminal 10 and the second selection terminal 12 are conductive with each other to make the second selection terminal 12 nonconductive, so that the turn-off circuit of the vehicle interior lamp is opened, and the turn-on circuit is closed.

Figure 11A:
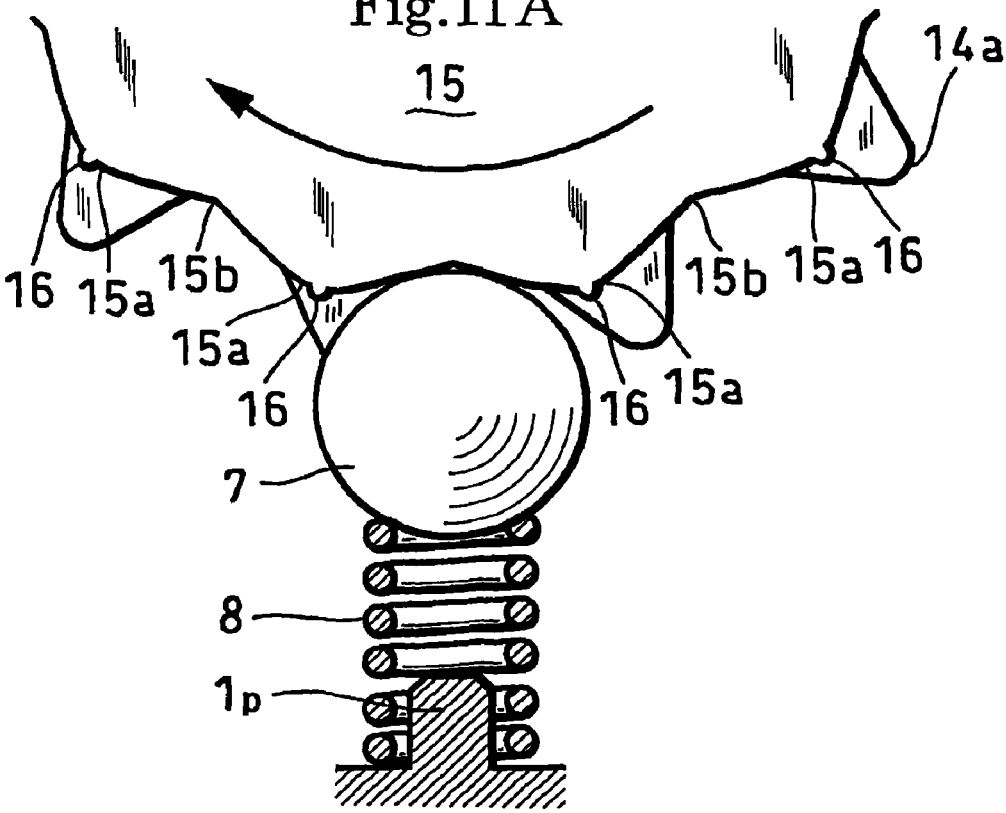
FIG. 11A is a partial enlarged front view of the positioning mechanism portion of the push-button switch of the embodiment of the invention.
Figure 11B:
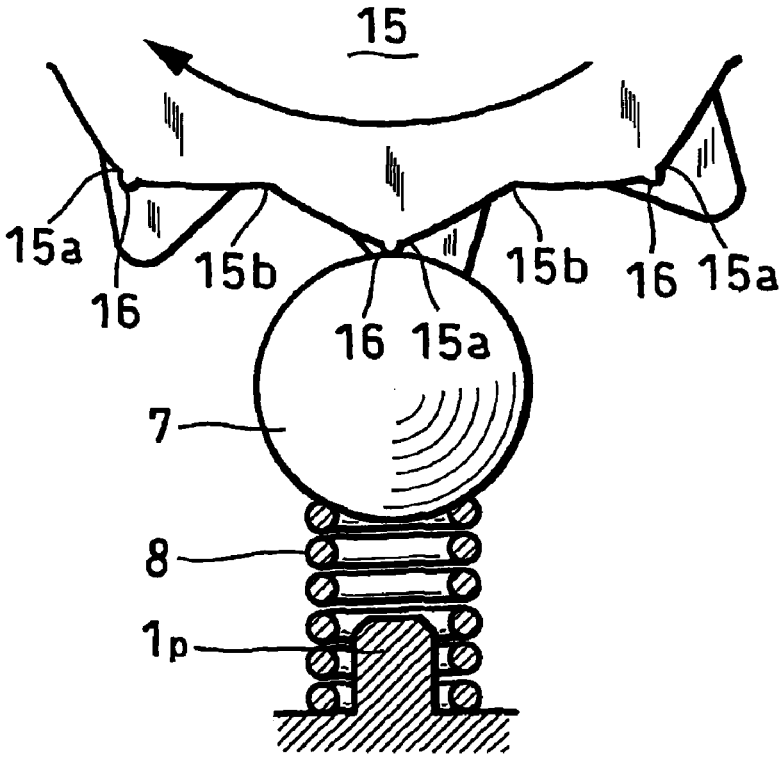
FIG. 11B is a partial enlarged front view of the positioning mechanism portion in the course of operation.

When the contacts are switched as described above, as shown in FIGS. 11A and 11B, the rotor 6 is rotated while the indenter 7 which is pressed by the indenter spring 8 from the immediately below side against the outer periphery of the positioning star wheel 15 is vertically moved between the ridge portions 15*a* and valley portions 15*b* that are alternately disposed on the outer periphery of the positioning star wheel 15. The indenter 7 is fitted into the valley portion 15*b* of the positioning star wheel 15 that is opposed thereto at the rotation angle of 30 deg. of the rotor 6 at which the contacts are switched, and the positions of the rotor 6 and the contact 9 are held to the rotated positions, thereby holding the positions of the movable contacts 9*h* after the contacts are switched. When the indenter 7 is contacted with the outer periphery of the positioning star wheel 15 on which the ridge portions 15*a* and the valley portions 15*b* are alternately disposed, it is possible to produce a sense of operation.

When the pressing of the push button 4 is released, the sliding portion 4*a* and the feed lever 4*c* are upward moved integrally with the push button 4 by the push-button return spring 5, to return to the original return state. However, the position of the rotor 6 is fixed by the indenter 7, the indenter spring 8, and the positioning star wheel 15, and the state of the contact is held as it is.

When the push button 4 is again pushed and depressed, the rotor 6 and the contact 9 are rotated about the rotor shafts 1*f*, 6*b* by a rotation angle of 30 deg. in the direction a (clockwise direction), and in conjunction with the rotation the three movable contacts 9*h* are rotated about the rotor shafts if, 6*b* by the rotation angle of 30 deg. in the direction a (clockwise direction) to be contacted respectively with the contacts corresponding to the rotation angle. In a similar manner as the contact state shown in FIG. 10A, as a result, the common terminal 10 and the first selection terminal 11 are conductive with each other to make the second selection terminal 12 nonconductive, so that the turn-on circuit of the vehicle interior lamp is opened, and the turn-off circuit is closed.

The above-described operations are repeated, and the two kinds of switch circuits are opened/closed by a depression of the push button.

In the push-button switch, the small projection 16 is disposed in the apex of each of the ridge portions 15*a* of the positioning star wheel 15. When a load of the indenter 7 is applied to the apex of the ridge portion 15*a*, therefore, the small projection 16 causes a balance to be hardly established, so that, even when the inclination angle of the slope of the ridge portion 15*a* is not made large, the phenomenon that the positioning star wheel 15 is stopped at a position where the ridge portion 15*a* is opposed to the indenter 7 can be prevented from occurring. Consequently, it is possible to realize correct and stable switching of the contacts. Since the inclination angle of the slope of the ridge portion 15*a* is not made large, the effect can be exerted while, as the number of operations of pressing the push button 4 is more increased, the effect is not further lessened to finally disappear. Since the height of the ridge portions 15*a* can be reduced, moreover, the switch can have a low profile.

Furthermore, the tip end of each small projection 16 is rounded. Therefore, the small projection shows excellent abrasion resistance, so that it is possible to surely prevent the phenomenon that, as the number of operations of pressing the push button 4 is more increased, the above-discussed effect is further lessened, and finally disappears, from occurring.

The above effects can be achieved by the small projection 16 which is very smaller than the ridge and valley portions 15*a*, 15*b* and indenter 7 of the positioning star wheel 15. Therefore, a force required for the small projection 16 to override the indenter 7 is negligibly small as compared to that required for the ridge portion 15*a* to override the indenter 7. The contact switching can be performed by a switch operating force which is equivalent to that in the prior art, and the small projection 16 does not affect the operational sense, so that an operational sense which is equivalent to that in the prior art is obtained.

What is claimed is:

1. A push-button switch, including:

a push button that automatically returns;

a spring;

a star wheel which is rotated by a constant angular step in one direction by a depression of said push button, said star wheel having an outer periphery and a plurality of ridge portions;

an indenter being pressed against said outer periphery of said star wheel by said spring;

a contact mounted to said star wheel so as to corotate with said star wheel, and which serves as a movable contact;

terminals with which said contact is contacted in accordance with a rotation angle, and which serve as stationary contacts; and a small projection which has a substantially semicircular section shape and whose tip end is rounded and is disposed in a rounded apex of each of said ridge portions of said star wheel.

2. The push-button switch as defined in claim 1, wherein:

said star wheel includes a rotation star wheel and a positioning star wheel.

3. The push-button switch as defined in claim 2, wherein:

said contact engages said rotation star wheel.

4. The push-button switch as defined in claim 1, further including:

a case defining a space within which said star wheel is mounted, and within which said indenter is located, wherein:

said push-button is mounted to said case for reciprocation relative thereto.

5. A push-button switch comprising:

a star wheel which has alternately ridge portions and valley portions on an outer periphery thereof and which is rotated by a constant angular step in one direction by a depression of a push button that automatically returns;

a movable contact which is attached to the side face of said star wheel so as to corotate with the star wheel; and terminals which serve as stationary contacts, and with which said movable contact is contacted in accordance with a rotation angle, and an indenter placed on a side of the outer periphery of said star wheel, which is pressed against the outer periphery of said star wheel by a spring so as to make it possible to rotate the star wheel, which is fitted into a certain one of the valley portions, and which holds positions of the star wheel and the movable contact in a return state where the pressing of the push button is released; wherein a small projection which has a substantially semicircular section shape and whose tip end is rounded is disposed in a rounded apex of each of ridge portions of said star wheel so that the star wheel can be prevented from being stopped at a position where the ridge portion is opposed to the indenter when said star wheel is rotated by a constant angular step in one direction by the depression of the push button.

* * * * *